US005950364A

United States Patent [19]

Hörmann

[11] Patent Number: 5,950,364

[45] Date of Patent: Sep. 14, 1999

[54] MONITORING THE MOTION OF A DRIVE-OPERABLE, ONE OR MULTIPLE PART DOOR BODY

[75] Inventor: Michael Hörmann, Halle/Westf., Germany

[73] Assignee: Marantec Antriebs-und Steurungstechnik GmbH & Co. Produktions KG, Marienfeld, Germany

[21] Appl. No.: 08/741,872

[22] Filed: Oct. 28, 1996

[30] Foreign Application Priority Data

Oct. 31, 1995 [DE] Germany ..... 195 40 620

[51] Int. Cl.[6] ..... E05F 15/02

[52] U.S. Cl. ..... 49/26; 49/506

[58] Field of Search ..... 49/26, 27, 28, 49/31, 506, 197; 160/1

[56] References Cited

U.S. PATENT DOCUMENTS 5,051,672 9/1991 Yaguchi .
5,131,506 7/1992 Mizuno et al. .
5,278,480 1/1994 Murray .
5,315,220 5/1994 Takimoto et al. .

FOREIGN PATENT DOCUMENTS 0012528 6/1980 European Pat. Off. .
0079801 3/1983 European Pat. Off. .
0083947 7/1983 European Pat. Off. .
0410204 1/1991 European Pat. Off. .
4000730 8/1991 Germany .
4206272 9/1993 Germany .

*Primary Examiner*—Daniel P. Stodola
*Assistant Examiner*—Curtis Cohen
*Attorney, Agent, or Firm*—Dilworth & Barrese

[57] ABSTRACT

A method for monitoring motion of a drive-operable door body between open and closed positions. To monitor movement as sensitively as possible, an actually occurring course of movement is compared with a previously fixed nominal course. A signal for interrupting movement is generated when the nominal course and the actual course, and/or one of the derivations of these, differ from one another by a previously fixed amount.

16 Claims, 2 Drawing Sheets

MONITORING THE MOTION OF A DRIVE-OPERABLE, ONE OR MULTIPLE PART DOOR BODY

BACKGROUND OF THE INVENTION

The present invention relates to a method for the monitoring of the motion of a drive-operable, one or multiple part door body, particularly an overhead door, along the movement path between the open and closed position and for the interruption of this motion, particularly by switching off and over the drive in the event of an obstacle in the path of movement which the door body runs against with the following steps:

an actual course which really occurs and dependence on the movement path or the time of a physical operating value of the movement of the door body is recorded, and an interruption signal for the interruption of the motion of the door body being monitored is generated if the currently recorded value of the actual course differs by a previously determined amount from the corresponding value of a nominal course with the nominal course on the basis of a physical operating value being recorded and stored at least once before the putting into operation of the door for an obstacle-free normal operation along the movement path or the time, and to a means to perform the method in accordance with a door drive, a measuring element to measure the movement path, a measuring element to measure a physical operating value of the door motion, a memory to store the nominal course and/or actual course determined by the measuring elements in dependence on the movement path or the time and a control unit to evaluate the nominal course and the actual course and to generate an interruption signal.

Such a method and such a means are known from EP-B1-0 083 947. The monitoring unit disclosed therein is based on the basic idea that the actual course of the required force to drive the door body over the movement path is compared continuously with the nominal course. If the difference between actual course and nominal course exceeds a previously fixed amount, an interruption signal is generated which switches off the door body drive or reverses its direction of movement. The nominal course is here recorded and stored at least once prior to the putting into operation of the door for an obstacle-free normal operation along the movement path.

Such a monitoring system possesses an improved hazard protection over other known monitoring systems such as electrical contacts positioned underneath yielding bulges. Nevertheless cases can still occur with such a monitoring means where the criterion to generate the interruption signal is not sufficiently sensitive. If the door body edge contacts soft obstacles, for example, the motion force for the movement of the door body increases more slowly than against a hard obstacle so that a longer period passes before the interruption signal is triggered. If, therefore, the edge of the door body laterally contacts, for example, the groin of person accidentally crossing the motion path during the movement of the door body, then is it possible that the interruption signal of the monitoring device will not be triggered early enough.

SUMMARY OF THE INVENTION

It is therefore the object of the present invention to monitor as sensitively as possible the motion of movement between the open position and the closed position of doors of the type in question for any deviation from normal operation.

Based on a method of the generic type this object is solved in accordance with the present invention by the steps of an actually occurring actual change of course dependent on the movement path or the time is determined by forming the derivation according to the movement path or the time for every recorded value of the actual course, and an interruption signal for the interruption of the motion of the monitored door body is generated if the currently determined value of the actual change of course differs to a previously determined extent from the corresponding value of a nominal change of course with the nominal change of course being determined and stored at least once before the putting into operation of the door based on the nominal course. The solution in accordance with the invention consists of the fact that in addition to the known methods a derivation of the actual course of a physical operating value of the door movement is formed at each scanned point in accordance with the movement path and that an interruption signal is generated even if a criterion is not met in accordance with the derivation determined. The nominal course of the corresponding physical operating value is here recorded and stored at least once before the putting into operation of the door for an obstacle-free normal operation along the movement path.

The advantages achieved with the present invention comprise particularly the monitoring unit reacting equally sensitively when the door contracts hard objects and/or soft objects. This improvement can be achieved here with relatively low effort over a monitoring unit of the generic type.

Preferably, for the formation of the actual change of course and/or the nominal change of course the first derivation is formed according to the movement path or the time; however, higher derivations can also be used.

The difference value to be given, by which the actual change of course has to differ from the nominal change of course in order to signal the event of an obstacle, is, on the one hand, dependent on external influences such as wind influences, slight icing and similar and, on the other hand, it takes slight changes in the run resistance into account. In accordance with a preferred embodiment a fixed difference value is fixed beforehand over the total motion run, but in principle the difference value can, however, also be measured differently over the movement path, particularly to compensate for the different wind impairment depending on the motion path already laid back.

In principle, the nominal course and the actual course can be derived from different physical operating values of the forward movement, but preferably the same physical starting values will be evaluated for both values.

In accordance with a preferred embodiment the nominal course is only recorded and stored after the installation of the door on site and then the nominal change of course should be determined and also stored. In this way, the actually occurring operating relationships can be taken into account under normal conditions in a realistic manner with the actually prevailing environmental influences. As the operating relationships can change over time due to wear or similar, the nominal course can be recorded and stored again after certain operating intervals of the door and a new nominal change of course determined from this. It is naturally, however, also possible to give and store the nominal course at the time of manufacture depending on the type of door. The nominal change of course can also be determined and stored once, but it is also possible to have the nominal change of course determined again during operation for every movement of the door body on the basis of the nominal course.

The determination in dependence on the path of a physical operating value of the door body motion can be done in various ways. Preferably, the driving force of the door body is used as the basis with this being able to be determined in turn by a direct measurement of force or also by a measurement of torque. A preferred method of measuring the torque consists of determining the torsion angle between two coupling elements connected elastically to one another and positioned behind one another as part of the path of the driving force. However, it is also possible to monitor in a known fashion the performance of an electrical drive motor or the current supplied with a constantly applied voltage.

If the above measuring values of a physical operating value of the motion of a door body are recorded in dependence on the movement path, then it is necessary for this purpose that the movement path itself also be determined by a suitable measuring device. For this purpose, preferably a pulse generator is used which is also driven by the driving motor. In connection with two switch elements which detect the opening position and the closing position of the door body, the current position on the movement path can be determined with the pulse generator within the resolution precision of the pulses emitted.

In accordance with another preferred embodiment it is provided that the rate of motion of the door body is taken as a measure of a physical operating value of the motion. Here, the rate of motion is no longer recorded in dependence on the movement path but in dependence on the time. A course of speed for normal operation without any obstacles also recorded in dependence on the time serves as the nominal course. To measure the rate of motion a tachometer generator or also a pulse generator can be used which can be driven by the door drive. While the pulses emitted by the pulse generator have still to be derived into a frequency proportional to the speed, the tachometer generator already supplies a voltage proportional to the rate of motion of the door.

Another solution of the above task in accordance with the invention consists of a device to perform the method in accordance with the invention with the control unit possessing a derivative element which generates a nominal change of course from the nominal course and/or an actual change of course from the nominal course each in dependence on the movement path or the time, the nominal change of course and/or the actual change of course can be stored in the memory and the nominal change of course and the actual change of course can be evaluated by the control unit.

In accordance with its basic design, the device comprises a door drive, a measuring element to measure the movement path, a measuring element to measure a physical operating value of the door movement, a control unit with memories for the measuring values and a derivative element.

In accordance with a preferred embodiment the control unit comprises a microcontroller in which corresponding memories and A/D converters have already been integrated. Preferably, the derivative element is also implemented on the microcontroller in the form of a software logic. However, it is also feasible that the derivative element comprises an analog derivator whose signal is also supplied to an A/D converter. In any case, the derivative element must be designed in such a way that the current derivation of the input signal in question is determined reliably independent of momentary noise interference.

In accordance with another preferred embodiment the door drive comprises an electrical motor. The power of the electrical motor supplied can here be taken directly as the measure for a physical operating value of the door motion. With a constantly supplied voltage, the current supplied to the electrical motor can also serve as the basis for a physical operating value with the current being measured then approaching a measure for the moment given by the electrical motor.

In accordance with another preferred embodiment it is provided that the interruption signal generated by the control unit results in a switching off of the electrical motor. However, it is also possible that the direction of drive of the door drive will reverse as a result of the interruption signal which can be done with a suitable electrical motor by reversing the polarity of the supply voltage or also by a suitable gear.

BRIEF DESCRIPTION OF THE DRAWINGS

Further details and advantages of the invention are described in more detail by means of an embodiment shown in the drawing where.

DESCRIPTION OF THE PREFERRED EMBODIMENTS

Figure 1:
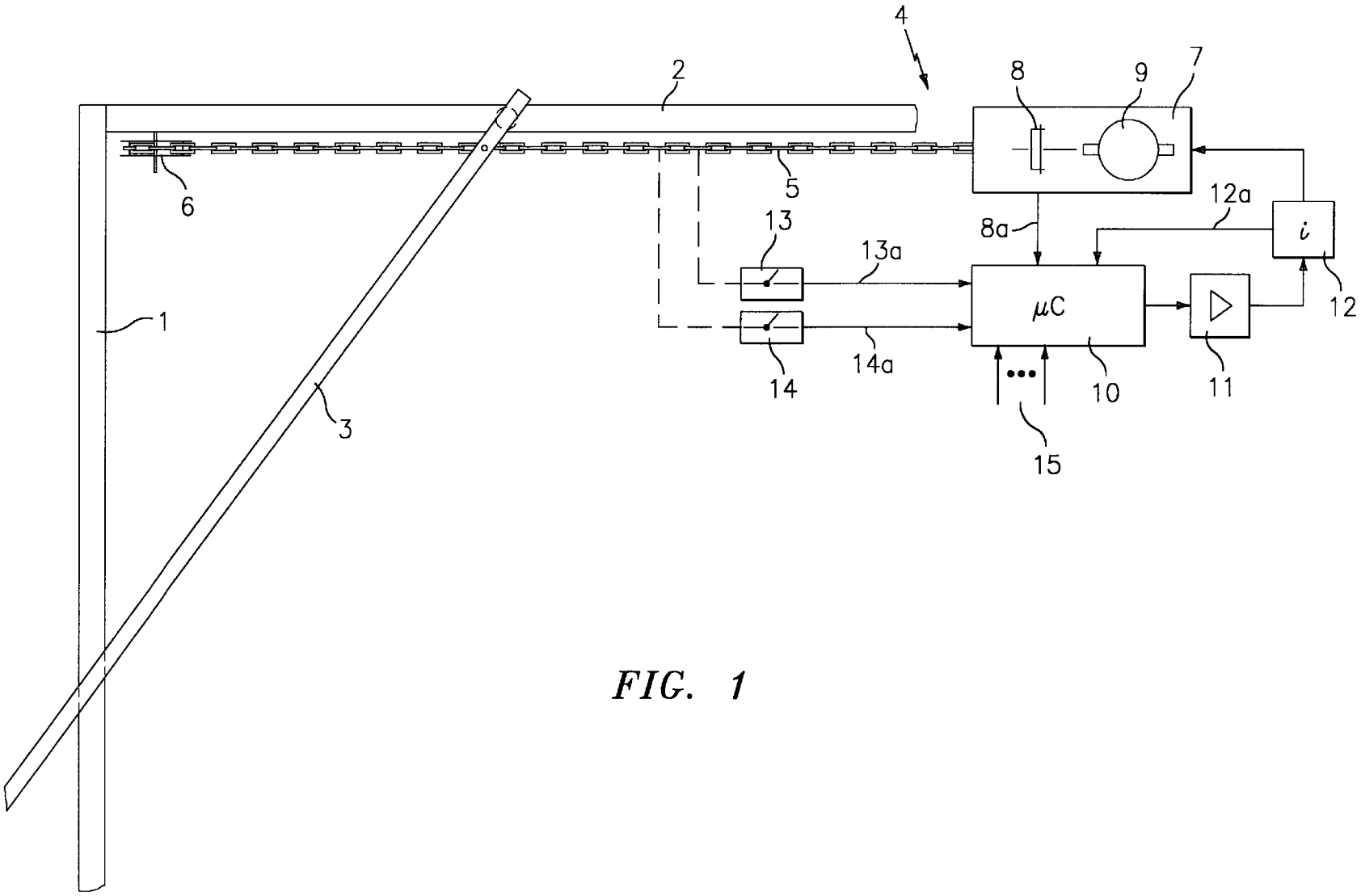
FIG. 1 is a schematic representation of a garage door movable overhead with a block diagram of the monitoring system in accordance with the invention.

The garage door from FIG. 1 possesses two vertical braces 1 to whose top end two rails 2 connect in which the door body 3 is guided. The door body 3 is further hinged to the braces 1 with a connecting rod not shown so that the door body can be opened and closed with an overhead movement. In addition, equalizing springs are provided which largely compensate the door body's own weight during the movement and which hold the door body in its defined end positions. The drive system designated with number 4 consists in total of a drag-chain drive with a drag chain 5, to which the door body 3 is hinged and which is guided over the turn pulley 6 and over a drive pulley (not shown). The drive pulley is located in the drive unit 7 and is driven by the electrical motor 9 via a gear. Also driven by the electrical motor 9 is an impulse generator 8 which is mounted on an elastic coupling and which emits a pulse after every certain angle of rotation.

The whole system is controlled by the control unit 10 which consists of a microcontroller with an integrated memory and A/D converters. The output signal of the control unit 10 is supplied to an amplifier 11 which supplies the required power to the electrical motor 9 via a current measuring element 12. The input values of the control unit include the measuring values 8*a* and 12*a*, the switch signals 13*a* and 14*a* and input signals 15 (not specified in any detail) which can include signals of an operating unit or also a voltage supply.

The signal 8*a* of the pulse generator is evaluated by the control unit in connection with signals from switch elements 13 and 14. Here the switch elements are actuated by the door body 3 in its end positions, that is in the vertical and in the horizontal position in each case. Signals 13*a* and 14*a* therefore each serve as start/stop signals in order to ensure a reliable upward integration of the signal 8*a*.

Figure 2B:
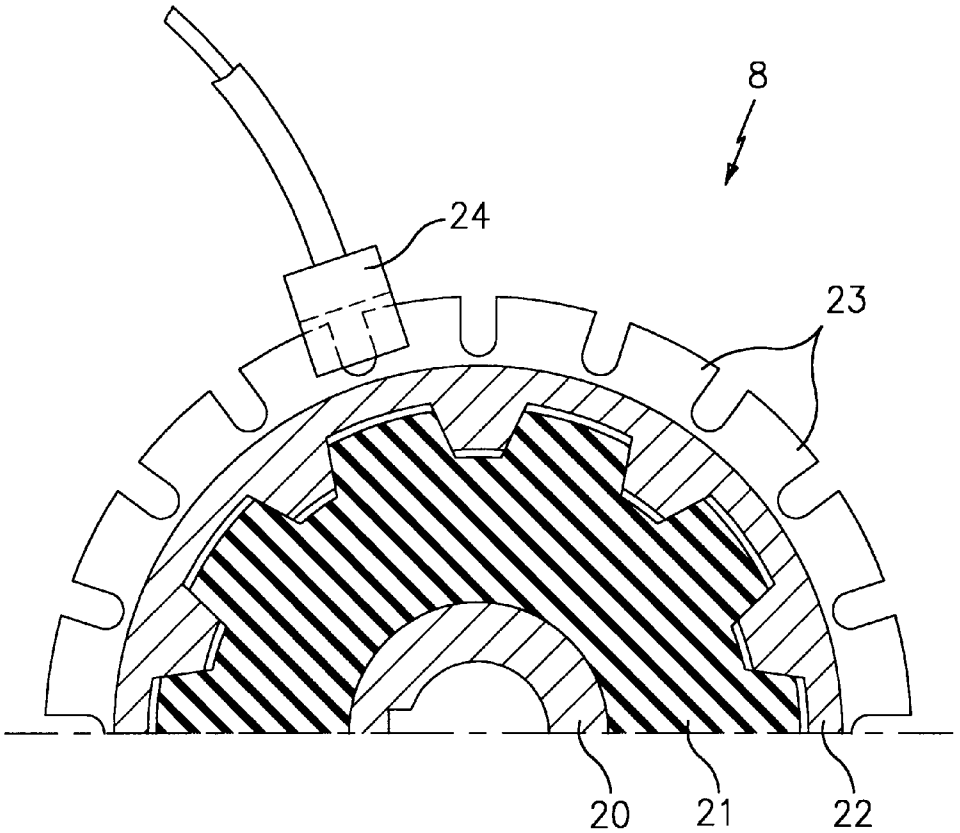
FIG. 2*b* is a side view of the schematic representation of a pulse generator on an elastic coupling.
Figure 2A:
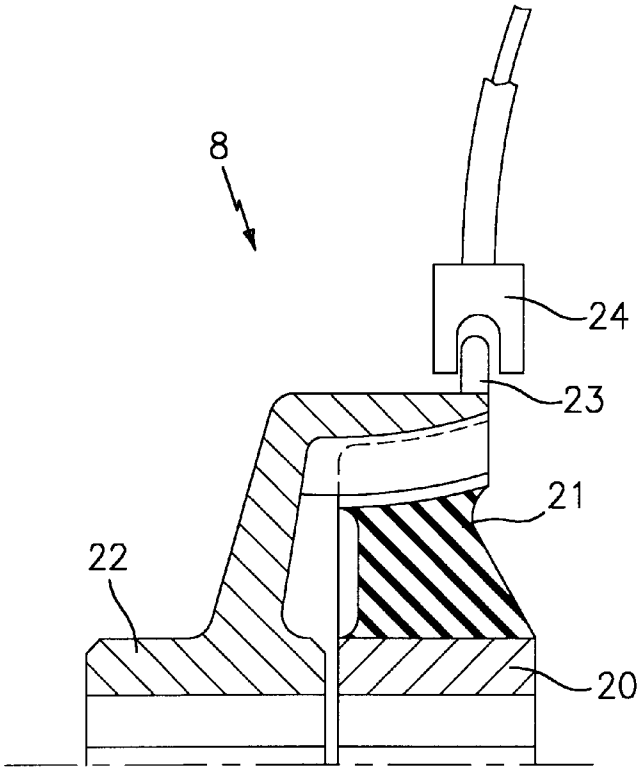
FIG. 2*a* is a front view of a schematic representation of a pulse generator on an elastic coupling.

FIGS. 2*a* and 2*b* show a possible embodiment of the pulse generator 8. In an axial cross-section and in a radial section a coupling is shown which is provided between the driving wheel of the drag chain 5 and the outlet of the drive motor 9. The driven coupling half 20 is designed as a rotating, elastic coupling element with a radial intermediate layer between teeth and hub, for example in the form of a rubber ring 21. The output coupling half 22 possesses on its radial circumference teeth 23 which are sensed by the inductive generator 24. When the coupling turns, the inductive generator 24 then emits corresponding pulses due to the periodic change in the inductance.

With such an elastic coupling it is also possible to determine the torque given by the electrical motor 9 by measuring the angle of torsion between the driven coupling half 20 and the output coupling half 22. In the present embodiment this is, however, done by the current measuring element 12 which measures the current supplied to the electrical motor. The evaluation of the measuring signals 8*a* and 12*a* is described here in the following:

Before the door drive is put into operation the nominal course of the motor current for obstacle-free normal operation is recorded in dependence on the movement path. For this purpose, the signals 8*a* and 12*a* are read into the microcontroller via A/D converters at identical scan times and stored in such a way that an allocation of values of identical times is possible. Together with the control program of the drive control the nominal course thus recorded is stored in the EPROM so that the values can be reloaded into the RAM at every reset of the microcontroller.

During an opening or closing movement of the door body an actual course of the motor current according to the nominal course is recorded in dependence on the movement path. For each actual value recorded a calculation process is performed before the recording of the next actual value, that is within one scan period, which calculation process checks whether any unpermitted differences from the nominal course exist and whether accordingly an interruption signal has to be generated.

For this purpose, first each actual value recorded is compared to the corresponding nominal value for identical values of the movement path. If the actual value differs from the nominal value by a previously determined amount, then an interruption signal is generated by the microcontroller which signal results in a reversal of the drive direction of the door body.

If, in contrast, the actual course is within a permitted range, then in a next step for the currently recorded actual value the derivation is formed in dependence on the movement path. For this purpose, different methods are feasible, the simplest consists of the forming of a difference between the currently recorded actual value and the previously recorded actual value. If the actual values are particularly loaded with noise, then a smoothing of the previous values may be necessary prior to forming the difference. To do this, a certain number of previously recorded actual values are interpolated with a given function before the derivation is then formed from this interpolated function. The currently determined derivation is included in an actual change of course which is compared with a nominal change of course. This nominal change of course was also determined and stored in accordance with the method just described prior to the putting into operation based on the already recorded nominal course. If the actual change value differs from the nominal change value by a previously determined amount, then an interruption signal is generated which in the results in a reversal of the drive direction of the door body.

In accordance with the method described above, the already known criterion between nominal course and actual course is therefore supplemented by an additional criterion between nominal change of course and actual change of course which allows a more exact evaluation for the generation of an interruption signal. Of course, in addition to the derivation criterion other further criteria are feasible, in particular the nominal course can be compared more and more exactly with the actual course by forming further derivations. The limit here is formed by the already mentioned noise behavior of the two signals with a minimum tolerance width being required between the actual course and the nominal course so that the interruption signal is not triggered when not desired.

In addition to the method described for the recording of the nominal and actual courses in dependence on the movement path, it is besides also possible to record the actual and nominal courses in dependence on the time. The requirement for this is that the course of movement of the door body does not change over time. For this purpose it must be ensured that friction influences and any other interference influences can be neglected. This can be taken into account in a limited fashion by the nominal course being recorded again after regular maintenance intervals. If the interference influences can accordingly be neglected, then it is also possible to dispense with the current sensor 12 by having the rate of speed of the door body being determined over time from the signal of the pulse generator 8.

I claim:

1. Method for monitoring movement of a drive-operatable door or part thereof along a movement path between open and closed positions and for interrupting the movement in event of obstacle in the path of movement, comprising the steps of recording and storing a predetermined value of a position of a nominal course of movement at least once before setting the door thereof into motion, currently recording a value of the position of an actual course of movement of the door or part thereof, generating an interruption signal for interrupting the movement of the door or part thereof when the currently recorded value of the position differs by a predetermined amount from the corresponding predetermined value of a nominal course of movement of the door and part thereof, determining an actually occurring change of course of movement based upon at least one of an actually-occurring movement path and time by forming a derivation of at least one of the movement path and time for every recorded value of the actual course of movement by forming the derivation of the actually-occurring change of course as a first mathematical derivation of the movement path and time, generating an interruption signal for interrupting motion of the door or part thereof if the currently determined value of the actually occurring change of course differs by a previously-determined extent from a corresponding value for a nominal change of course, and determining and storing the nominal change of course at least once before setting the door or part thereof into motion based upon the nominal course.

2. Method according to claim 1, comprising the step of determining difference of the actual change of course from the nominal change of course as a constant over the movement path or time.

3. Method according to claim 1, comprising the step of determining difference of the actual change of course from the nominal change of course depending upon wind factors.

4. Method according to claim 1, comprising the step of deriving at least one of the actual course and actual change of course from physical operating values previously queried to record at least one of the nominal course and nominal change of course.

5. Method according to claim 1, comprising the steps of recording and storing the nominal course for obstacle-free normal operation after installation of the door or part thereof on site, and determining and storing the nominal change of course from the nominal course.

6. Method according to claim 1, comprising the additional steps of recording and storing the nominal course anew after certain operating intervals of the door or part thereof, and determining and storing a new nominal change of course from the new nominal course.

7. Method according to claim 1, comprising the additional step of determining at least one of the actual course and nominal course from at least one of the following steps (i)–(v):

(i) measuring driving force depending on at least one of the movement path and time;

(ii) measuring driving torque depending on at least one of the movement path and time;

(iii) measuring torsion angle between two torsion elements connected elastically to one another and position behind one another as part of a path of driving force;

(iv) measuring an electrical drive circuit of an electrical drive unit for the door/part thereof depending upon at least one of the movement path and time; and (v) measuring rate of motion of the door/part thereof depending upon time.

8. Method according to claim 1, comprising the step of determining the movement path with a pulse generator in conjunction with one or more limit switches.

9. Apparatus for performing the method of claim 1, comprising a measuring element (8) for measuring the movement path, a measuring element (12) for measuring a physical operating value of the door or part thereof (3) in motion, a memory for storing at least one of the nominal course of movement and actual course of movement determined by the measuring elements (8, 12), and a control unit (10) for evaluating the nominal course, actual course and generating the interruption signal, wherein the control unit (10) possesses a derivative element for generating at least one of a nominal and actual change from the nominal course, each depending upon at least one of the movement path and time, the memory is arranged to store at least one of the nominal and actual change of course, and the control unit (10) is arranged to evaluate the nominal and actual change of course.

10. Apparatus according to claim 9 wherein the control unit (10) comprises a microcontroller, the measuring element (8) comprises a pulse generator, comprising a door drive (7) coupled to the control unit (10) and door or part (3) thereof and which is an electrical motor (9); and the measuring element (12) is arranged to measure current supplied to the electrical motor (9) with constantly applied voltage.

11. Apparatus according to claim 10, additionally comprising A/D converters arranged for transforming signals from the measuring elements (8,12) into digital signals.

12. Apparatus according to claim 9, wherein the control unit (10) is structured and arranged for generating the interruption signal to switch off a door drive (7) or result in reversal of drive direction of the door drive (7) which is coupled to the control unit (10) and door or part thereof (3).

13. Apparatus according to claim 9, wherein the door/part thereof (3) is structured to be hinged to two vertical braces (1) of a door jamb and be guided in two top end rails (2) connected to the vertical braces (1), and a door drive (4) coupled to the door or part thereof (3) and control unit (10) comprises a drag-chain drive having a drag-chain (5) to which the door or part thereof (3) is hinged, a turn pulley (6) mounted upon at least one of the top end rails (2), a drive pulley coupled to the drag-chain (5), an electrical motor (9) arranged to drive the drive pulley, an impulse generator (8) arranged to be driven by the electrical motor (9) and an elastic coupling upon which the impulse generator (8) is mounted and which emits a pulse after certain angles of rotation.

14. Apparatus according to claim 13, wherein the control unit (10) comprises a microcontroller with an integrated memory and A/D converters, an amplifier (11) arranged to receive an output signal from the control unit (10), and the physical measuring element is a current measuring element (12) arranged to supply required power to the electrical motor (9) from the amplifier (11), and switch elements (13, 14) are arranged to be actuated by the door or part thereof (3) in vertical and horizontal end positions and transmit signals (13*a*, 14*a*) serving as start/stop signals to ensure reliable upward integration of a signal (8*a*) transmitted to the control unit (10) by the pulse generator (8) and a signal (12*a*) transmitted to the control unit (10) from the current measuring element (12).

15. Apparatus according to claim 14, wherein the pulse generator (8) comprises a coupling provided between the driving pulley of the drag chain (5) and an outlet of the drive motor (9) and having a driven coupling half (20) structured and arranged as a rotating elastic element with a radial intermediate layer between teeth and hub, and an output coupling half (22) structured and arranged to possess, on a radial circumference thereof, teeth (23), and an inductive generator (24) arranged to sense the teeth (23) and emit corresponding pulses due to periodic change in inductance when the coupling turns.

16. Method for monitoring movement of a drive-operatable door or part thereof along a movement path between open and closed positions and for interrupting the movement in the event of an obstacle in the path of movement, comprising the steps of recording and storing a pre-determined value of a position of a nominal course of movement at least once before setting the door or part thereof into motion, currently recording a value of the position of an actual course of movement of the door or part thereof, generating an interruption signal for interrupting the movement of the door or part thereof when the currently recorded value of the position differs by a predetermined amount from the corresponding predetermined value of a nominal course of movement of the door or part thereof, determining an actually occurring change of course of the movement based upon at least one of and actually-occurring movement path and time by forming a derivation of at least one of the movement path and time for every recorded value of the actual course of movement, generating an interruption signal for interrupting the movement of the door or part thereof if the currently determined value of the actually occurring change of course differs by a previously-determined extent from a corresponding value for a nominal change of course, determining and storing the nominal change of course at least once before setting the door/part thereof into motion based upon the nominal course, during opening or closing of the door part, recording an actual course of motor current according to the nominal course depending upon movement path, for each actual value recorded, performing a calculation for recording of a next actual value within one scan period, this calculation checking whether any unpermitted difference from the nominal course exists and whether an interruption signal must be generated, comparing first, each actual value recorded to a corresponding nominal value for identical values of movement path, and if the actual value differs from the nominal value by a previously determined amount, then generating an interruption signal by micro controller which results in a reversal of drive direction of the door part, if the actual course is within a permitted range, then, in a subsequent step for the currently recorded value, forming a derivation depending upon movement path by at least one of the following steps (i)–(v);

(i) forming a difference between the currently recorded actual value and the previously recorded actual value;

(ii) if the actual values are loaded with noise, then smoothing the previous values by interpolating a certain number of previously recorded actual values with a given function before a derivation is then formed from this interpolated function;

(iii) determining the current derivation and including the same in an actual change of course which is compared with a nominal change of course;

(iv) determining and storing the nominal change of course prior to introducing the door or part thereof into operation based upon the already recorded nominal course; and (v) if the actual change of course value differs from the nominal change of course value by a previously determined amount, then generating an interruption signal which, in turn, results in a reversal of the drive direction of the door or part thereof.

* * * * *